US007712188B2

(12) United States Patent
Sung

(10) Patent No.: US 7,712,188 B2
(45) Date of Patent: May 11, 2010

(54) HINGE FOR PORTABLE COMPUTER

(75) Inventor: Chien-Ming Sung, Taipei Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 742 days.

(21) Appl. No.: 11/459,652

(22) Filed: Jul. 25, 2006

(65) Prior Publication Data

US 2007/0234516 A1 Oct. 11, 2007

(30) Foreign Application Priority Data

Mar. 28, 2006 (TW) ..... 95205142 U

(51) Int. Cl.
*E05C 17/64* (2006.01)

(52) U.S. Cl. ..... 16/339; 16/340; 16/330

(58) Field of Classification Search ..... 16/303, 16/330, 337, 338, 339, 340, 374; 403/71, 403/68, 120; 455/575.1, 575.3; 361/679.06, 361/679.08, 679.12, 679.27
See application file for complete search history.

(56) References Cited

U.S. PATENT DOCUMENTS 5,022,778 A * 6/1991 Lu ..... 403/120
6,163,928 A * 12/2000 Chung ..... 16/342
6,321,416 B1 * 11/2001 Lu ..... 16/374
6,481,057 B2 * 11/2002 Lin ..... 16/340
6,671,929 B1 * 1/2004 Lu ..... 16/342
6,779,234 B1 * 8/2004 Lu et al. ..... 16/340
6,804,859 B2 * 10/2004 Lu et al. ..... 16/342
6,983,514 B2 * 1/2006 Lu et al. ..... 16/342
2003/0097732 A1 * 5/2003 Kim ..... 16/337
2004/0025098 A1 * 2/2004 Meyer ..... 714/736
2004/0088825 A1 * 5/2004 Lu ..... 16/285
2007/0094842 A1 * 5/2007 Chang ..... 16/330
2007/0136992 A1 * 6/2007 Lu et al. ..... 16/330

* cited by examiner

*Primary Examiner*—Chuck Y. Mah
(74) *Attorney, Agent, or Firm*—Thomas, Kayden, Horstemeyer & Risley

(57) ABSTRACT

A portable computer includes a monitor, a base, and a hinge. The hinge includes a shaft sleeve, a rotary shaft, a driven element, and a resistance structure. The shaft sleeve is fixed to the base. The rotary shaft is fixed to the monitor and disposed in the shaft sleeve. The driven element is connected to and driven by the rotary shaft. The resistance structure is disposed adjacent to the driven element, wherein the driven element does not contact the resistance structure when the rotary shaft is rotated in a first angular range, and the driven element contacts the resistance structure and sustains a resistance when the rotary shaft is rotated in a second angular range.

19 Claims, 6 Drawing Sheets

HINGE FOR PORTABLE COMPUTER

BACKGROUND OF THE INVENTION

1. Field of the Invention

The invention relates to a hinge for a portable computer, and in particular relates to a hinge for a portable computer requiring less torque to open and greater torque to close.

2. Description of the Related Art

Referring to FIG. 1, a portable computer has a monitor 32 and a base 31 connected by a hinge (not shown). The hinge allows the monitor 32 to rotate with respect to the base 31. Currently, the torque required for operating a hinge of a portable computer is constant. Operation of a conventional hinge is described via a torque curve in the following:

FIG. 2 depicts a torque curve of a hinge for a portable computer, wherein the hinge does not maintain the monitor in a closed position. Rather, the monitor is locked in the closed position via a latch (not shown). To open the monitor, the latch must be released. As shown in FIG. 2, the required torque T is a constant $A_1$ as the monitor is opened ($\theta$=0°–180°) and a constant "A" as the monitor is closed ($\theta$=180°–0°), wherein $A_1$=0.7A–0.75A.

FIG. 3 depicts a torque curve of another hinge for a portable computer, wherein the hinge is capable of maintaining the monitor in a closed position. In this case, no latch is provided for locking the monitor in the closed position. It is noted that the torque is not zero at $\theta$=0° for the hinge to position the monitor. Furthermore, the required torque T remains constant through most of the process of operation. Specifically, the required torque T is a constant $A_1$ during opening of the monitor ($\theta$=15°–180°) and a constant "A" during closing of the monitor ($\theta$=180°–15°). In FIG. 3, $A_0$=1.2A.

Different designs may have different structural specifications for hinges, although the performance of hinges in portable computers is similar. Thus, only the torque curves of the hinges have been described and structural descriptions of the hinges have been omitted.

To meet design requirements, the battery in a typical portable computer is generally disposed at the rear of the base and near the hinge. The battery is a heavy element in the portable computer. Such an arrangement concentrates the weight of the portable computer at the rear. As a possible result, the base is raised when the monitor is opened. Alternatively, after the monitor is rotated to an angle, the base may accidentally fall and collide with a table or be raised along with rotation of the monitor. Thus, the monitor must be opened with both hands.

BRIEF SUMMARY OF THE INVENTION

An object of the invention is to provide a hinge for a portable computer preventing the described problems. The hinge requires less torque for opening, and greater torque for closing the monitor. The torque required for operating the hinge of the invention depends on the position of the monitor.

An exemplary embodiment of the portable computer includes a monitor, a base, and a hinge. The hinge includes a shaft sleeve, a rotary shaft, a driven element, and a resistance structure. The shaft sleeve is fixed to the base. The rotary shaft is fixed to the monitor and disposed in the shaft sleeve. The driven element is connected to and driven by the rotary shaft. The resistance structure is disposed adjacent to the driven element, wherein the driven element does not contact the resistance structure when the rotary shaft is rotated in the shaft sleeve within a first angular range, and the driven element contacts the resistance structure and sustains a resistance when the rotary shaft is rotated in the shaft sleeve within a second angular range.

Because the resistance depends on the rotational angle of the monitor, the torque required for operating the hinge depends on the position of the monitor. The torque required for opening the monitor is less than that for closing it. Thus, the monitor can be opened with one hand and the base of the portable computer is prevented from accidentally impacting another surface. The invention may provide more convenient operation and prevent accidental collision in operation.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

To smoothly rotate the monitor, the torque required for operating the hinge of the invention depends on the position of the monitor. In the following descriptions, the torque curve of the hinge prior to the structure of the hinge is introduced.

Figure 1:
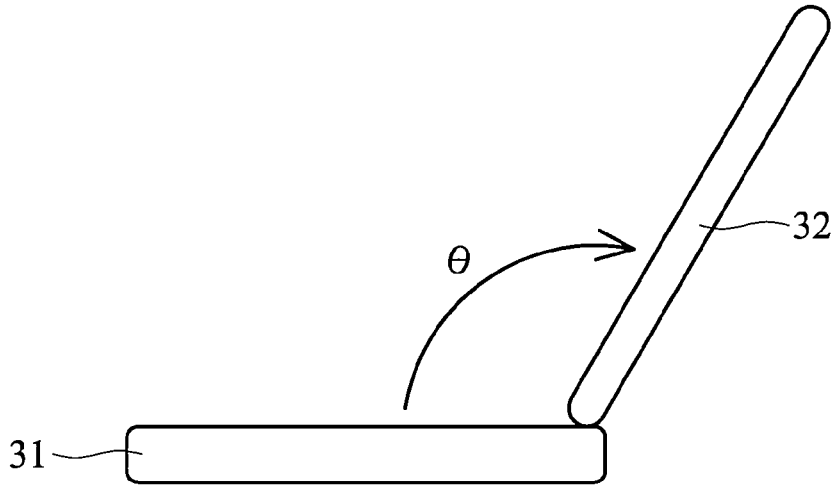
FIG. 1 (RELATED ART)
FIG. 1 is a schematic diagram of a portable computer.
Figure 2:
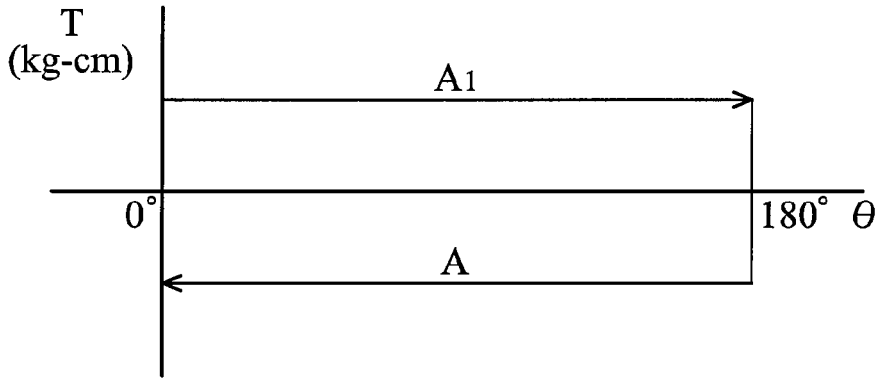
FIG. 2 (RELATED ART)
FIG. 2 depicts a torque curve of a hinge for a portable computer.
Figure 3:
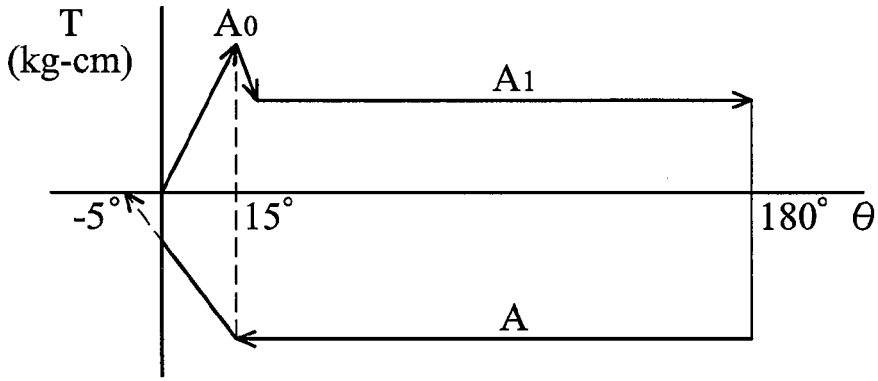
FIG. 3 (RELATED ART)
FIG. 3 depicts a torque curve of another hinge for a portable computer.
Figure 4:
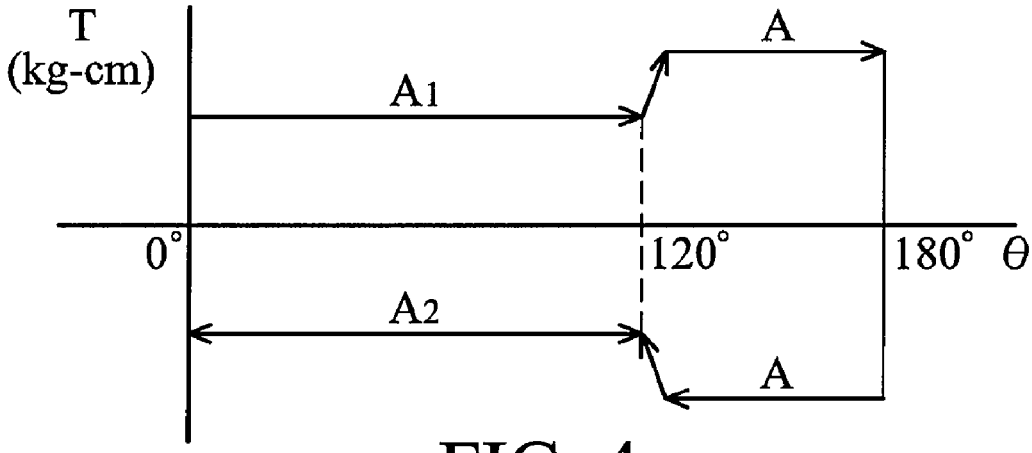
FIG. 4 depicts a torque curve of a hinge in accordance with the invention.

FIG. 4 depicts a torque curve of a hinge of the invention, wherein the hinge does not have a function for maintaining the monitor in the closed position. As the monitor is opened, the required torque T is a constant "$A_1$" in the angular range of $\theta$=120°–180°, and increases to a constant "A" in the angular range of $\theta$=120°–180°. That is, the initial required torque is small, and then increases. Thus, if the user releases the monitor in the angular range of $\eta$=120°–180°, rotation of the monitor in the opened direction due to gravity will be prevented. During the process of closing the monitor, the required torque T is a constant "A" in the angular range of $\theta$=180°–120°, preventing rotation of the monitor in the opened direction due to gravity, and reduces to a constant $A_2$ in the angular range of $\theta$=120°–0°, wherein $A_2$=0.9A. It is noted that the torque $A_2$(=0.9A) required for closing the monitor exceeds that required for opening the monitor $A_1$(=0.7A–0.75A). Thus, opening the monitor requires more effort than closing it. Such a design prevents the monitor from continuing to rotate in the angular range of $\theta$=60°–0° in the closed direction due to gravity.

Figure 5:
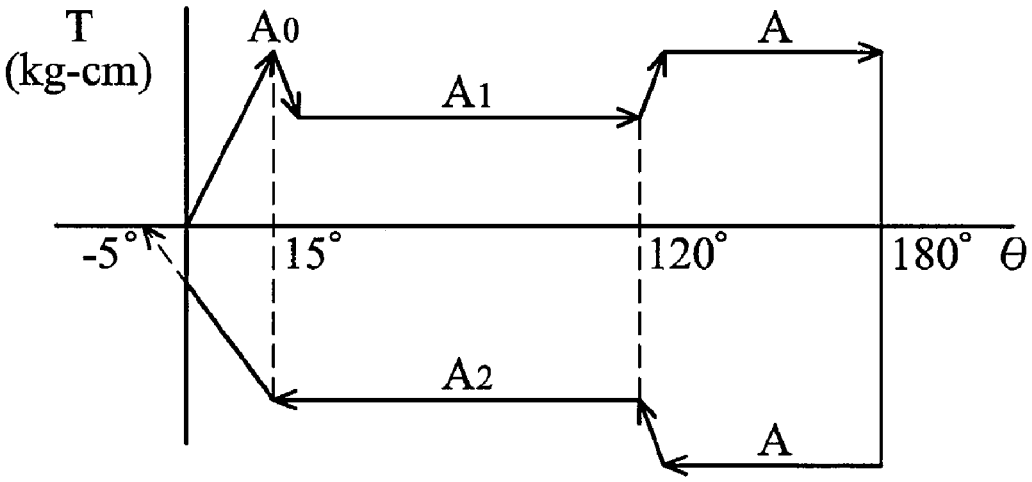
FIG. 5 depicts a torque curve of another hinge in accordance with the invention.

FIG. 5 depicts a torque curve of another hinge of the invention, wherein the hinge is capable of maintaining the monitor in the closed position. Thus, the required torque for operating the hinge is not zero at the angle θ=0°. As shown in FIG. 5, the required torque T changes at the angle θ=120°, similar to that shown in FIG. 4. Thus, the introduction of the torque curve is omitted.

Figure 6:
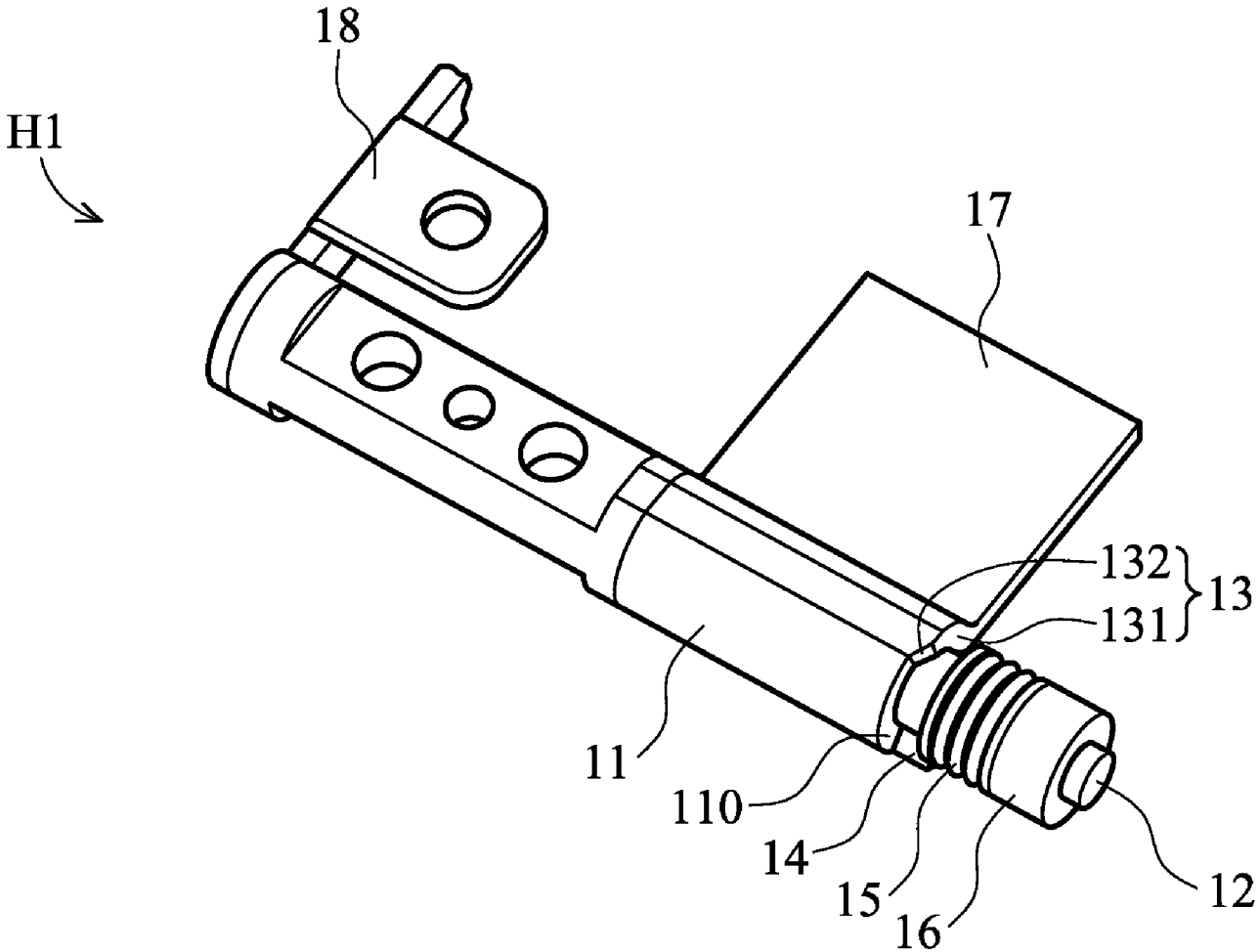
FIG. 6 is a schematic diagram of a hinge in accordance with a first embodiment of the invention.
Figure 7:
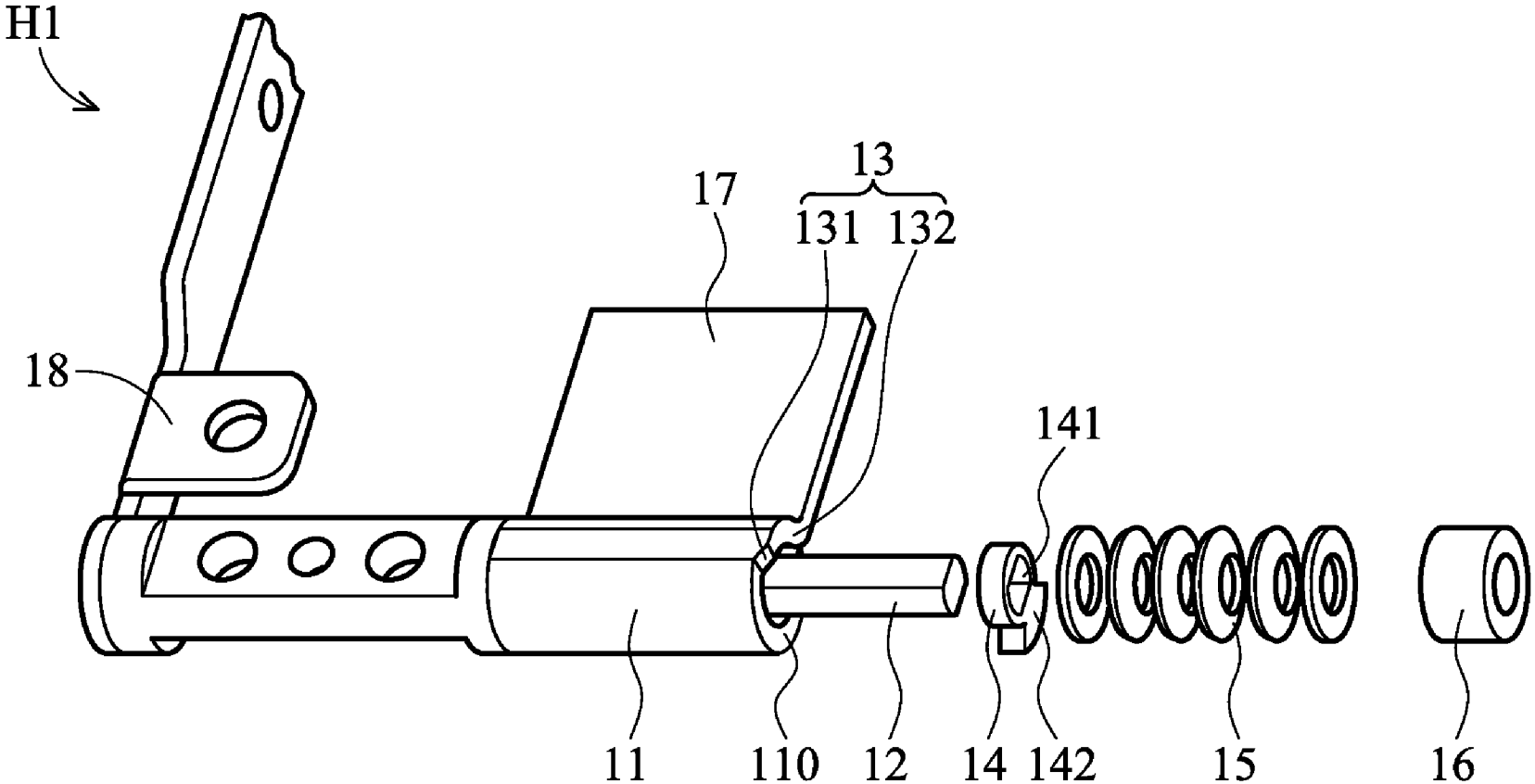
FIG. 7 is an exploded view of the hinge of FIG. 6.

Referring to FIGS. 6 and 7, FIGS. 6 and 7 are schematic diagrams of a hinge H1 in accordance with a first embodiment of the invention. The hinge H1 comprises a shaft sleeve 11 having an end surface 110, a rotary shaft 12 disposed in the shaft sleeve 11, a resistance structure 13, and a driven element 14 connected to and driven by the rotary shaft 12. The resistance structure 13, disposed between the shaft sleeve 11 and the driven element 14 to be separably contacted by adjacent to the driven element 14, comprises a slope portion 131 relatively slanted from the end surface 110 of the shaft sleeve 11 and a flat portion 132 connected to the slope portion 131. The shaft sleeve 11 is fixed to the base (not shown) of a portable computer through a connecting element 17 which is connected to the flat portion 132 of the resistance structure 13, while the rotary shaft 12 is fixed to the monitor (not shown) through another connecting element 18. The rotary shaft 12 is rotated in the shaft sleeve 11 by the monitor when the monitor is rotated with respect to the base. Note that the slope portion 131 of the resistance structure 13 is increasingly and relatively slanted from the end surface 110 of the shaft sleeve 11.

The driven element 14 has a convex part 142 and a through hole 141. The rotary shaft 12 passes through the through hole 141 of the driven element 14. The cross section of the rotary shaft 12 is non-circular and matches the shape of the through hole 141 of the driven element 14. Thus, the rotary shaft 12 is capable of rotating the driven element 14.

The rotary shaft 12 sequentially passes through the shaft sleeve 11, the driven element 14, a plurality of gaskets 15, and a retaining element 16. The retaining element 16 is fixed to the rotary shaft 12. The driven element 14 and the gaskets 15 are clamped by the shaft sleeve 11 and the retaining element 16.

The resistance structure 13 protrudes from an end surface 110 of the shaft sleeve 11 and adjacent to the driven element 14. When the rotary shaft 12 is rotated in the shaft sleeve 11 within a first angular range (e.g. θ=0°–120°), the driven element 14 is rotated by the rotary shaft 12 without contacting the resistance structure 13. The torque required for operating the hinge is small. When the rotary shaft 12 is rotated in the shaft sleeve 11 within a second angular range (e.g. θ=120°–180°) different from the first angular range, the driven element 14 contacts the resistance structure 13 and sustains a resistance. Thus, the torque required for operating the hinge increases from constant $A_1$ to constant "A" as shown in FIGS. 4 and 5.

Figure 8:
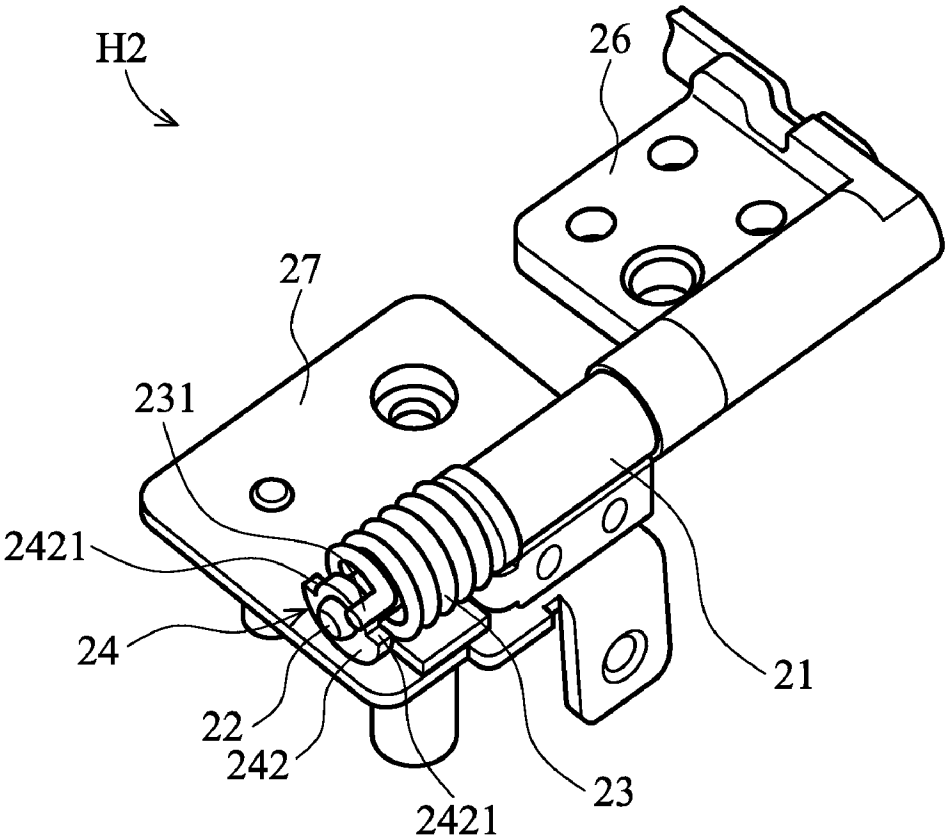
FIG. 8 is a schematic diagram of a hinge in accordance with a second embodiment of the invention.

FIG. 8 is a schematic diagram of a hinge H2 in accordance with a second embodiment of the invention, wherein the hinge H2 comprises a shaft sleeve 21, a rotary shaft 22 disposed in the shaft sleeve 21, a driven element 24 connected to and driven by the rotary shaft 22 and comprising two end surfaces 2421, and a torsional spring 23 substantially disposed between the shaft sleeve 21 and the driven element 24. The shaft sleeve 21 is fixed to the base (not shown) of a portable computer through a connecting element 27, while the rotary shaft 22 is fixed to the monitor (not shown) through another connecting element 26. The rotary shaft 22 is rotated in the shaft sleeve 21 by the monitor when the monitor is rotated with respect to the base. The driven element 24 comprises a convex part 242 having two end surfaces 2421 and a through hole 241. The torsional spring 23 comprises an acting end 231 to be separably contacted by the one of the end surfaces 2421 of the convex part 242 of the driven element 24. In this embodiment, the resistance structure 23 is constituted by a torsional spring, and one end (not shown in FIGS.) of the torsional spring is fixed to the connecting element 27.

Figure 9:
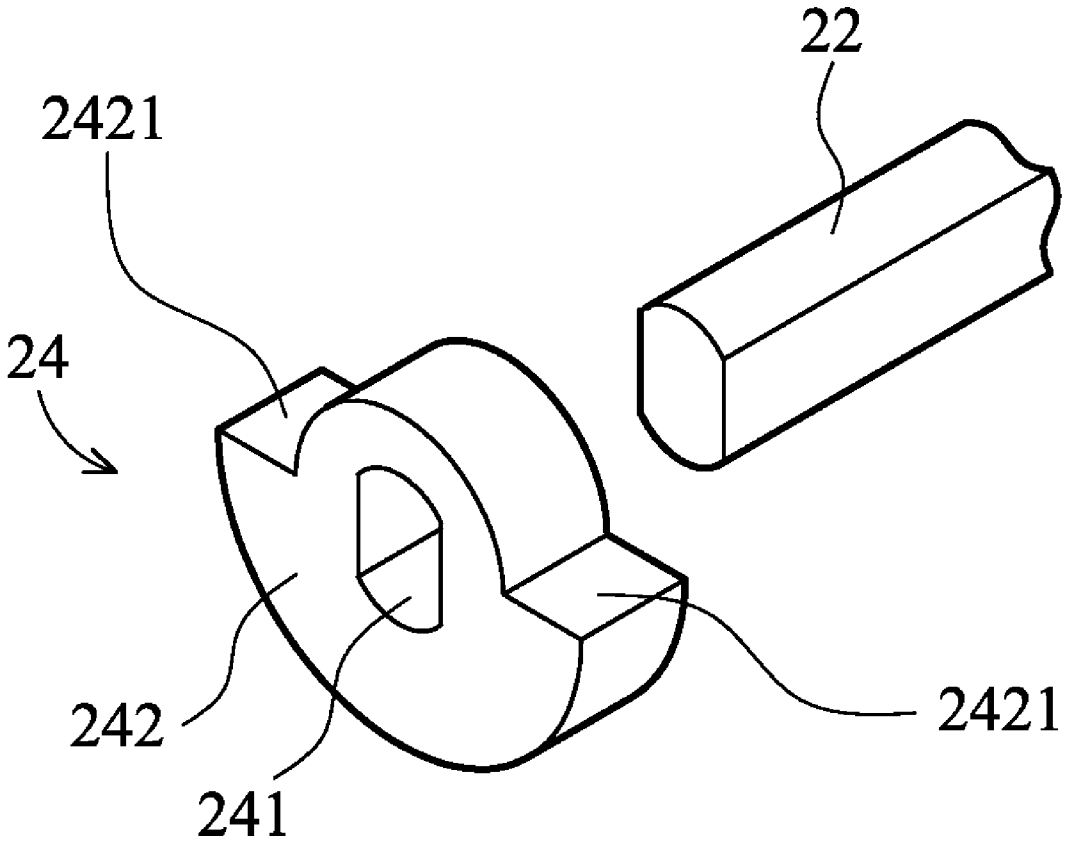
FIG. 9 is an exploded view showing the driven element and the rotary shaft of the hinge in accordance with the second embodiment of the invention.

Referring also to FIG. 9, the rotary shaft 22 passes through the through hole 241 of the driven element 24. The cross section of the rotary shaft 22 is non-circular and matches the shape of the through hole 241 of the driven element 24. Thus, the rotary shaft 22 is capable of rotating the driven element 24.

When the rotary shaft 22 is rotated in the shaft sleeve 21 within a first angular range (e.g. θ=0°–120°), the end surface 2421 of the driven element 24 is rotated by the rotary shaft 22 without contacting the acting end 231 of the resistance structure 23. The torque required for operating the hinge is small. When the rotary shaft 22 is rotated in the shaft sleeve 21 with a second angular range (e.g. θ=120°–180°), the end surface 2421 of the driven element 24 contacts the acting end 231 of the resistance structure 23 and sustains a resistance. Thus, the torque required for operating the hinge increases from constant $A_1$ to constant "A" as shown in FIGS. 4 and 5.

In the invention, the torque required for operating the hinge depends on the position of the monitor. The torque required for opening the monitor is less than that for closing it. Thus, the monitor can be opened with one hand and the base of the portable computer is prevented from accidentally impacting another surface. The invention may provide more convenient operation and prevent accidental collision in operation.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A hinge, comprising:

a shaft sleeve comprising an end surface;

a rotary shaft disposed in the shaft sleeve;

a driven element connected to and driven by the rotary shaft, wherein the driven element comprises a convex part; and a resistance structure disposed between the shaft sleeve and the driven element to be separably contacted by the driven element, comprising a slope portion relatively slanted from the end surface of the shaft sleeve;

wherein the driven element does not contact the slope portion of the resistance structure when the rotary shaft is rotated in the shaft sleeve within a first angular range, and the convex part of the driven element contacts the slope portion of the resistance structure and sustains a resistance when the rotary shaft is rotated in the shaft sleeve within a second angular range different from the first angular range.

2. The hinge as claimed in claim 1, wherein the rotary shaft has a non-circular cross section, the driven element defines a through hole matching the cross section of the rotary shaft, and the rotary shaft passes through the through hole of the driven element to rotate the driven element.

3. The hinge as claimed in claim 1, wherein the convex part of the driven element contacts the slope portion of the resistance structure and the rotary shaft is capable of rotating the driven element when the rotary shaft is rotated in the shaft sleeve within the second angular range.

4. The hinge as claimed in claim 1, wherein the resistance structure is integrally formed with the shaft sleeve.

5. The hinge as claimed in claim 1, further comprising a retaining element and a gasket, wherein the rotary shaft passes through the shaft sleeve, the driven element, the gasket, and the retaining element.

6. The hinge as claimed in claim 1, wherein the slope portion of the resistance structure is increasingly slanted from the end surface of the shaft sleeve.

7. The hinge as claimed in claim 1, wherein the first angular range is substantially ranged from 0 to 120°.

8. The hinge as claimed in claim 1, wherein the second angular range is substantially ranged from 120° to 180°.

9. A hinge, comprising:

a shaft sleeve;

a rotary shaft disposed in the shaft sleeve;

a driven element connected to and driven by the rotary shaft, comprising at least one end surface; and a torsional spring substantially disposed between the shaft sleeve and the driven element, comprising at least one acting end to be separably contacted by the at least one end surface of the driven element;

wherein the at least one end surface of the driven element does not contact the at least one acting end of the torsional spring when the rotary shaft is rotated in the shaft sleeve within a first angular range, and the at least one end surface of the driven element contacts the at least one acting end of the torsional spring and sustains the resistance when the rotary shaft is rotated in the shaft sleeve within a second angular range different from the first angular range.

10. The hinge as claimed in claim 9, wherein the driven element further comprises a convex part provided with the at least one end surface thereon.

11. The hinge as claimed in claim 9, wherein the first angular range is substantially ranged from 0 to 120°.

12. The hinge as claimed in claim 9, wherein the second angular range is substantially ranged from 120° to 180°.

13. A hinge, comprising:

a shaft sleeve comprising an end surface;

a rotary shaft disposed in the shaft sleeve;

a driven element connected to and driven by the rotary shaft; and a resistance structure disposed between the shaft sleeve and the driven element to be separably contacted by the driven element, comprising a slope portion relatively slanted from the end surface of the shaft sleeve;

wherein the driven element does not contact the slope portion of the resistance structure when the rotary shaft is rotated in the shaft sleeve within a first angular range, and the driven element contacts the slope portion of the resistance structure and sustains a resistance when the rotary shaft is rotated in the shaft sleeve within a second angular range different from the first angular range;

wherein the first angular range is substantially ranged from 0 to 120°.

14. The hinge as claimed in claim 13, wherein the rotary shaft has a non-circular cross section, the driven element defines a through hole matching the cross section of the rotary shaft, and the rotary shaft passes through the through hole of the driven element to rotate the driven element.

15. The hinge as claimed in claim 13, wherein the driven element comprises a convex part, and the convex part of the driven element contacts the slope portion of the resistance structure and sustains the resistance when the rotary shaft is rotated in the shaft sleeve within the second angular range.

16. The hinge as claimed in claim 13, wherein the resistance structure is integrally formed with the shaft sleeve.

17. The hinge as claimed in claim 13, further comprising a retaining element and a gasket, wherein the rotary shaft passes through the shaft sleeve, the driven element, the gasket, and the retaining element.

18. The hinge as claimed in claim 13, wherein the slope portion of the resistance structure is increasingly slanted from the end surface of the shaft sleeve.

19. The hinge as claimed in claim 13, wherein the second angular range is substantially ranged from 120° to 180°.

* * * * *